US006351249B1

(12) United States Patent
Wolfe, Jr.

(10) Patent No.: US 6,351,249 B1
(45) Date of Patent: Feb. 26, 2002

(54) ROOF-MOUNTED DISH ANTENNA HOUSING

(76) Inventor: Jack B. Wolfe, Jr., 8232 N. Daisy La., Jacksonville, FL (US) 32244

( * ) Notice: Subject to any disclaimer, the term of this patent is extended or adjusted under 35 U.S.C. 154(b) by 0 days.

(21) Appl. No.: 09/537,535

(22) Filed: Mar. 29, 2000

(51) Int. Cl.[7] ..... H01Q 3/08
(52) U.S. Cl. ..... 343/882; 343/872; 343/892
(58) Field of Search ..... 343/872, 882, 343/892, 840, 880, 766, 765, 878, 757, 915

(56) References Cited

U.S. PATENT DOCUMENTS

| | | | | | |
|---|---|---|---|---|---|
| 3,375,523 | A | | 3/1968 | Laibson | 343/765 |
| 3,427,626 | A | | 2/1969 | Losee | 343/872 |
| 3,714,660 | A | | 1/1973 | Scrafford et al. | 343/757 |
| 4,185,287 | A | * | 1/1980 | Hubing et al. | 343/872 |
| 4,312,002 | A | | 1/1982 | Stewart | 343/725 |
| 4,490,726 | A | | 12/1984 | Weir | 343/840 |
| 4,598,297 | A | * | 7/1986 | Hawkins | 343/882 |
| 4,672,385 | A | * | 6/1987 | Prindle | 343/882 |
| 4,710,778 | A | | 12/1987 | Radov | 343/882 |
| 4,804,972 | A | * | 2/1989 | Schudel | 343/872 |

* cited by examiner

*Primary Examiner*—Don Wong
*Assistant Examiner*—Chuc Tran
(74) *Attorney, Agent, or Firm*—Thomas C. Saitta

(57) ABSTRACT

A roof-mounted dish antenna housing comprising a dome which encloses a dish antenna, where the dish antenna is connected to the housing by pivoting bracket members mounted onto an annular mounting rim inside the dome, where the dish antenna can be rotated relative to the fixed dome in the azimuthal direction and angularly positioned relative to the fixed dome between the horizon and zenith by pivoting the attachment member connected to the dish antenna relative to the attachment member connected to the mounting rim. Part of the dome may be removable to allow for access from the external side of the roof, and vents may be provided to allow for air circulation.

26 Claims, 2 Drawing Sheets

ROOF-MOUNTED DISH ANTENNA HOUSING

BACKGROUND OF THE INVENTION

This invention relates generally to the field of roof mounted dish antennas for receiving satellite transmissions and to housings or canopies which contain the antennas in a protected and hidden manner.

Receipt of transmissions such as television in individuals houses or buildings is accomplished in various ways. The original system utilizes land-based broadcast towers to transmit waves which are received by roof-top or set-top antennas. In many areas, television is now available through cable transmission, where the signals are brought into the home through a land wire, but access requires that the land-based network be installed relative to the home to be connected. Another popular alternative is to provide a dish antenna capable of receiving signals transmitted from satellites positioned in geosynchronous or stationary earth orbit, as such systems allow for receipt of an increased number of broadcasts and can be utilized at any location regardless of whether a cable network has been completed in the region. While early satellite dishes, as the dish antennas are known, were relatively large, the satellite systems can now provide service through dish antennas with much smaller diameters, such as only 18 to 20 inches. Even with the reduction in size, the dish antennas are relatively unattractive, as they do not easily blend into the landscape. Furthermore, the problem of aesthetics is acerbated by the fact that for the antenna to work in an optimum manner, a clear line of sight must be provided to the transmitting satellite. Typically, the ideal location for the smaller dish antennas is on the roof of a house, since this allows interference from trees to be avoided most easily.

To solve the aesthetic problem in roof-mounted dish antennas, signal transparent housings or canopies have been proposed where the housing and dish antenna are positioned within and above an opening cut into the roof. The housings typically are formed of a polymer or plastic material, and present a similar appearance to a skylight when mounted onto the roof. Mounting flanges are provided which cooperate with the roof shingles such that the opening in the roof is sealed from the elements. Because a dish antenna must be aimed at a particular point in the sky corresponding to the fixed satellite location, it is necessary to provide mounting means which allow for proper positioning of the dish both angularly relative to the horizon and zenith and rotationally relative to the azimuthal compass direction. One example of such a system is shown in U.S. Pat. No. 4,710,778 to Radov. The mounting means disclosed by Radov is overly complicated in its mechanical components and its configuration, and thus it is an object of this invention to provide an improved roof-mounted dish antenna housing which not only allows for proper positioning of the dish antenna upon installation but which utilizes a more direct and less cumbersome mounting means for the dish antenna relative to the housing. It is a further object to provide such an apparatus where embodiments may also include access means such that a portion of the housing can be removed to provide access to the dish antenna, and vent members such that the internal temperature of the housing can be mitigated to prevent damage to the dish antenna or related electronic equipment. These and other objects contemplated but not expressly stated are accomplished as described in the disclosure to follow.

SUMMARY OF THE INVENTION

The invention is a roof-mounted dish antenna dome which comprises in general a canopy means comprising a dome or equivalently configured housing which defines an open interior space to receive a small dish antenna having a generally concave configuration and used to receive signals transmitted from a satellite in earth orbit. Such antennas are well known, and typically have a receiving dish of approximately 18 to 20 inches in diameter. It is necessary to locate the dish antenna where interference from trees, buildings and the like are minimized, and for aesthetic purposes it is desirable for the dish to be mounted or located in a hidden or unobtrusive spot. Positioning the antenna on the roof within a housing addresses both these concerns in a positive manner.

The canopy means includes roof mounting means, which may comprise an annular flange positioned at the base of the dome housing, where the annular flange is attached to the roof in conventional manner in conjunction with the shingles. An opening is provided in the roof for passage of cables and other necessary equipment and to provide access means for repair or adjustment of the dish antenna. The dome housing may comprise a cylindrical lower body and a curved or hemispherical upper member or top, and the upper member or the complete dome may be detachable from the annular flange, such that the upper portion or dome may be removed to provide access to the dish antenna from the outside of the roof. The canopy means may be vented to allow for the circulation of air to prevent extreme temperature conditions in the interior.

Adjustable dish mounting means are provided within the canopy means such that the dish antenna may be properly positioned for optimum reception of the satellite signals. Optimum positioning requires that the dish antenna be adjustable angularly relative to the horizon and the zenith by angular positioning means as well as rotationally relative to the compass directions by rotational positioning means. The rotational positioning means comprises an annular mounting rim circumscribing the cylindrical body portion of the dome housing. The angular positioning means comprises a pair of pivoting bracket members comprising a first or distal attachment member which connects to the mounting rim of the dome housing, and a second or proximal attachment member which connects to the dish antenna, where the distal and proximal attachment members are joined by a pivot hinge means such that each can be rotated about the hinge axis relative to the other.

Through this arrangement, the dish antenna can be properly aimed to any point in the sky regardless of the particular pitch or compass direction of the inclined roof by rotating the dish antenna relative to the mounting rim within the dome housing and by adjusting the angle of the proximal attachment members holding the rim of the dish relative to the distal attachment members connected to the mounting rim.

DETAILED DESCRIPTION OF THE INVENTION

With reference to the drawings, the invention will now be described in detail with regard for the best mode and the preferred embodiment. In a most general form, the invention comprises a housing, receptacle, canopy or other inclusive structure containing or for containing a conventional signal receiving satellite dish antenna which is mounted onto the roof of a house or building. Such antennas are well known in the art, and any antenna regardless of operational characteristics is suitable for use in the invention, and as such the dish antenna itself is described in detail herein. Typical dish antennas have a concave receiving dish approximately 18 to 20 inches in diameter to capture signal transmissions emitted by orbiting earth satellites, which are usually positioned in stationary or geosynchronous orbit. The captured signals are focused by the concave receiving dish onto signal relay means in communication with other electronic equipment, such as a television. The housing is transparent to the signal being received by the dish antenna, but provides an attractive and aesthetically pleasing architectural look by hiding the dish antenna itself, such that an external view of the building shows only the housing. The housing also protects the dish antenna and its accompanying electronics from temperature extremes and weather hazards such as high wind or hail.

Figure 1:
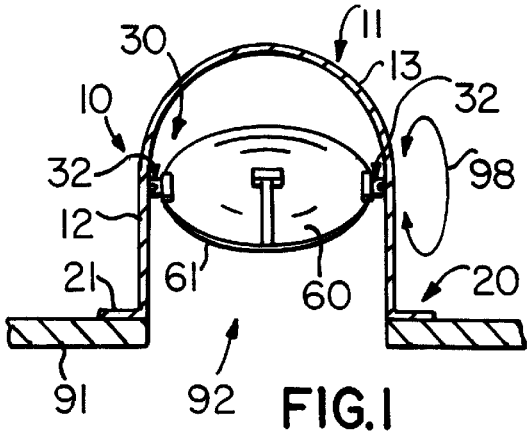
FIG. 1 is a cross-sectional front view of the invention.
Figure 2:
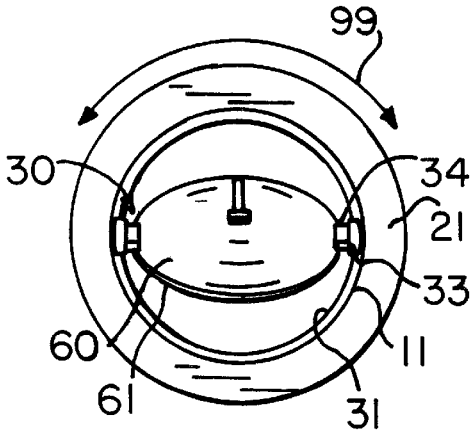
FIG. 2 is a top view of the invention.

As seen in FIGS. 1 and 2, the invention is a housing or canopy means 10 which is mounted onto the roof 91 of a home or other building in a secure manner over an opening 92 which provides a pathway into the interior of the home for the cables, wires or other necessary equipment (not shown), as well as providing access means from the interior of the roof 91 to adjust or repair the dish antenna 60 is necessary, provided the opening 92 is sized sufficiently large. The canopy means 60 is composed of a material transparent to the signals being received, and is preferably constructed of a tinted or colored hard plastic. The canopy means 10 is attached to the roof 91 in any suitable conventional manner by roof mounting means 20, which preferably comprises an annular flange 21 extending from the base of the canopy means 10. The annular flange 21 can be fastened to the roof 91 using adhesives or mechanical fasteners and is properly interfaced with the shingles such that water is precluded from entering the roof opening 92.

The canopy means 10 is preferably configured as a dome 11 having a generally curved or hemispherical top member 13 over a cylindrical body member 12, where the annular flange 21 for mounting the canopy means 10 is connected to the bottom of the cylindrical body member 12. The dome 11 is provided with an inwardly extending annular mounting rim 31, preferably at a location slightly below the junction of the top member 13 and cylindrical member 12. The annular mounting rim 31 comprises part of the dish mounting means 30 and acts as the track to receive a pair of pivoting bracket members 32.

Figure 3:
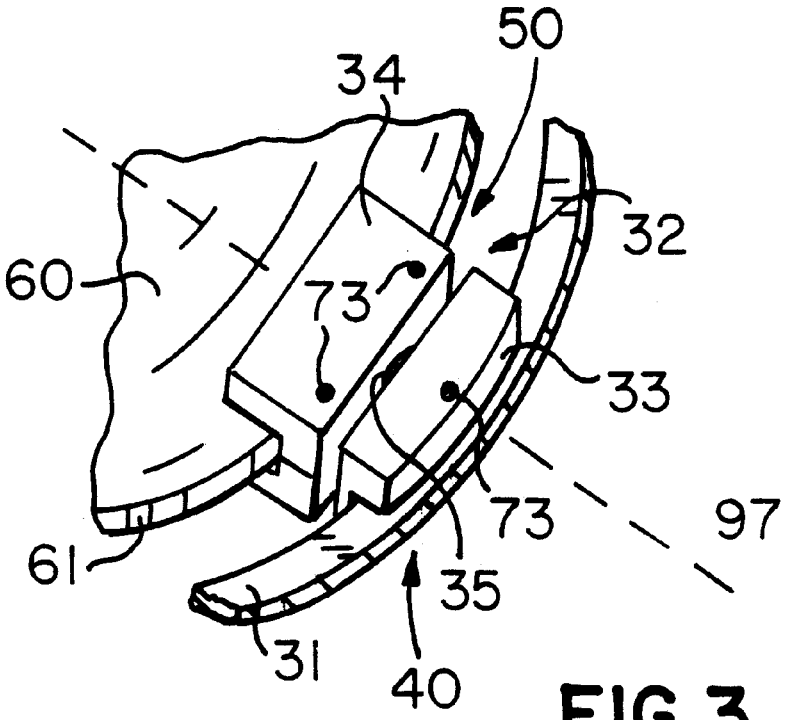
FIG. 3 is a view of the dish mounting means.

As shown in more detail in FIG. 3, the pivoting bracket members 32 comprise rotational positioning means 40 and angular positioning means 50 such that the dish antenna 60 can be positioned relative to the fixed canopy means 10 at any rotational point relative to the azimuthal or compass direction and at any angular point relative to the horizon and zenith. Each of the pivoting bracket members 32 comprises a first or distal attachment member 33 which is connected to the annular mounting rim 31 of the canopy means 10, and a second or proximal attachment member 34 which is connected to the rim 61 of the dish antenna 60. The distal attachment member 33 and proximal attachment member 34 are pivotally connected by a pivoting hinge means 35, such that the two attachment members 33 and 34 can be rotated about the hinge central axis 97 relative to each other. The distal attachment members 33 are generally C-shaped members which are sized to receive the annular mounting rim 31, with sufficient clearance such that the distal attachment members 33, and correspondingly the dish antenna 60 itself, can be rotated to any point along the annular mounting rim 31, as illustrated by arrow 99 in FIG. 2. Mechanical fastening members 73 may be utilized to secure the distal attachment members 33 in position after the dish antenna 60 has been optimally aimed relative to the azimuth.

The proximal attachment members 34 are preferably C-shaped clamping devices which are fastened onto the rim 61 of the dish antenna 60 using mechanical fasteners 73. Clamps are preferred since this method of attachment does not damage the dish antenna 60. The pivoting hinge members 35 allow the proximal attachment members 34, and correspondingly the dish antenna 60 itself, to be angled from zero to ninety degrees or from the horizon to the zenith relative to the distal attachment members 33, the fixed canopy means 10 and the roof 91, as illustrated by arrow 98 in FIG. 1. Thus, through the combination of the rotational and angular positioning means 40 and 50, the canopy means 10 can be mounted onto a roof of any pitch and the dish antenna 60 can be optimally aimed to any desired point corresponding to a transmitting satellite. Means are provided to lock or fix the proximal attachment members 34 at the appropriate angle relative to the distal attachment members 33 once the dish antenna 60 is properly aimed.

Figure 4:
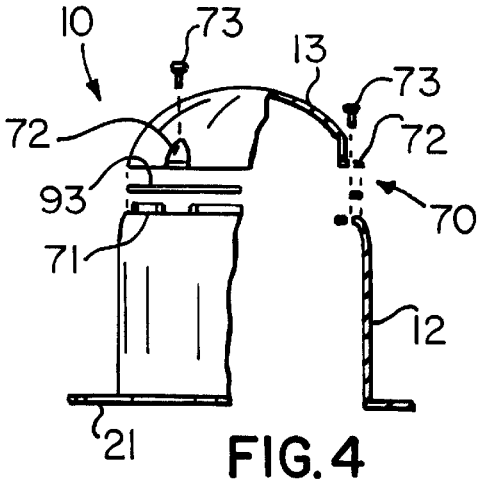
FIG. 4 is an expanded view of an alternative embodiment of the canopy means of the invention, shown partially in cross-section.

In an alternative embodiment of the invention, the dome 11 is constructed such that access to the interior can be obtained from the exterior of the roof 91, such as by providing a removable or sealable access means 70. As shown in FIG. 4, a preferred embodiment is to provide external access by constructing curved top member 13 of the dome 11 to be detachable or removable from the cylindrical body member 12. The body member 12 is provided with a shoulder 71 to receive and center the top member 13, which is attached using removable fasteners 73 positioned in fastener recesses 72 spaced about the perimeter of the top member 13. An annular gasket 93 may be provided to better seal the junction between the top member 13 and body member 12.

Figure 5:
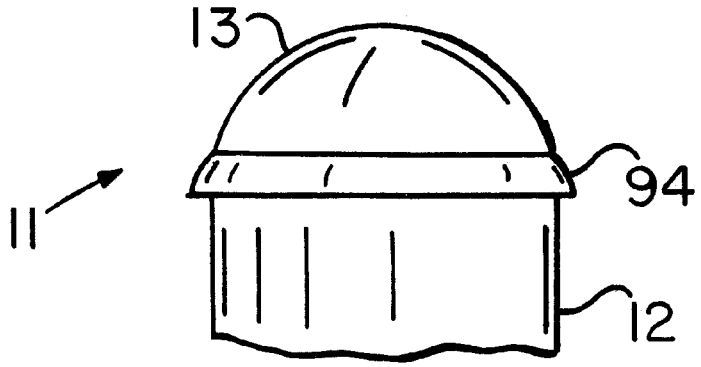
FIG. 5 is a side view of an alternative embodiment of the canopy means showing vent members.

In another alternative embodiment, as shown in FIG. 5, the canopy means 10 may be provided with vent members 94, preferably including screens to preclude passage of insects and debris into the interior, which allow air to flow into the interior of the dome 11, and also through the roof opening 92 if this is not intentionally occluded. The vent members 94 act to stabilize the temperature within the dome 11 to reduce detrimental effects from extreme hot or cold temperatures.

It is contemplated that equivalents and substitutions for certain elements and components described above may be obvious to those skilled in the art, and thus the true scope and definition of the invention is to be as set forth in the following claims.

I claim:

1. A roof-mounted dish antenna housing comprising a dish antenna, canopy means to enclose the dish antenna, roof mounting means for affixing the canopy means to a roof, and dish mounting means for mounting the dish antenna to the canopy means in an adjustable manner such that the dish antenna can be adjustably positioned relative to the fixed canopy means, where said dish mounting means comprises rotational positioning means where said dish antenna can be positioned rotationally relative to the azimuthal direction and angular positioning means where said dish antenna can be positioned angularly relative to the horizon and zenith, said dish mounting means comprising an annular mounting rim extending inwardly from said canopy means and a pair of pivoting bracket members each comprising a distal attachment member connected to said annular mounting ring and a proximal attachment member connected to said dish antenna, where said distal attachment member and said proximal attachment member are connected by a pivoting hinge member having a central axis such that said proximal attachment member can be rotated about said central axis relative to said distal attachment member.

2. The housing of claim 1, where said canopy means comprises a dome comprising a top member connected to a body member.

3. The housing of claim 2, where said roof mounting means comprises an annular flange connected to said cylindrical body member.

4. The housing of claim 2, where said top member is detachable from said body member.

5. The housing of claim 4, where said top member is hemispherical and said body member is cylindrical.

6. The housing of claim 1, where said canopy means further comprises vent members.

7. The housing of claim 1, where said distal attachment member is generally C-shaped.

8. The housing of claim 1, where said proximal attachment member is a generally C-shaped clamp.

9. The housing of claim 1, where said canopy means is composed of a plastic.

10. The housing of claim 5, where said body member further comprises a shoulder to receive said top member.

11. The housing of claim 10, where said top member is joined to said body member by removable mechanical fasteners.

12. The housing of claim 11, where said top member further comprises fastener recesses to receive said mechanical fasteners.

13. The housing of claim 10, further comprising a gasket positioned between said top member and said body member.

14. A roof-mounted housing for a dish antenna, said housing comprising canopy means to define an enclosed interior, roof mounting means for affixing the canopy means to a roof, and dish mounting means for mounting a dish antenna to the canopy means in an adjustable manner such that a dish antenna can be adjustably positioned relative to the fixed canopy means, where said dish mounting means comprises an annular mounting ring extending inwardly from said canopy means and a pair of pivoting bracket members each comprising a distal attachment member connected to said annular mounting ring and a proximal attachment member which receives a dish antenna, where said pivoting bracket members can be positioned rotationally relative to the azimuthal direction and where said proximal attachment members can be positioned angularly relative to the horizon and zenith, where said distal attachment members and said proximal attachment members are connected by a pivoting hinge member having a central axis such that each said proximal attachment member can be rotated about said central axis relative to said distal attachment member.

15. The housing of claim 14, where said canopy means comprises a dome comprising a top member connected to a body member.

16. The housing of claim 15, where said roof mounting means comprises an annular flange connected to said cylindrical body member.

17. The housing of claim 15, where said top member is detachable from said body member.

18. The housing of claim 17, where said top member is hemispherical and said body member is cylindrical.

19. The housing of claim 14, where said canopy means further comprises vent members.

20. The housing of claim 14, where said distal attachment member is generally C-shaped.

21. The housing of claim 14, where said proximal attachment member is a generally C-shaped clamp.

22. The housing of claim 14, where said canopy means is composed of a plastic.

23. The housing of claim 18, where said body member further comprises a shoulder to receive said top member.

24. The housing of claim 23, where said top member is joined to said body member by removable mechanical fasteners.

25. The housing of claim 24, where said top member further comprises fastener recesses to receive said mechanical fasteners.

26. The housing of claim 23, further comprising a gasket positioned between said top member and said body member.

* * * * *